United States Patent [19]

Tigane

[11] 4,437,823

[45] Mar. 20, 1984

[54] ROTARY MACHINE WITH AN AXIALLY MOVING PARTITION

[75] Inventor: Rein K. Tigane, Tallin, U.S.S.R.

[73] Assignee: Upravlenie Sanitarno-Tekhnicheskikh Rabot, Tallin, U.S.S.R.

[21] Appl. No.: 217,111

[22] PCT Filed: Feb. 29, 1980

[86] PCT No.: PCT/SU80/00040

§ 371 Date: Nov. 10, 1980

§ 102(e) Date: Nov. 10, 1980

[87] PCT Pub. No.: WO80/01934

PCT Pub. Date: Sep. 18, 1980

[30] Foreign Application Priority Data

Mar. 13, 1979 [SU] U.S.S.R. ..... 2729663
Mar. 13, 1979 [SU] U.S.S.R. ..... 2729664

[51] Int. Cl.[3] ..... F01C 1/00; F04C 18/00
[52] U.S. Cl. ..... 418/219; 418/232
[58] Field of Search ..... 418/217, 228–232, 418/216, 219

[56] References Cited

U.S. PATENT DOCUMENTS

| | | | |
|---|---|---|---|
| 548,112 | 10/1895 | Carpenter | 418/230 |
| 1,172,692 | 2/1916 | Fanning | 418/232 |
| 2,818,839 | 1/1958 | Voigt | 418/217 |
| 3,156,158 | 11/1964 | Pamplin | 418/217 |
| 3,205,663 | 9/1965 | Kluge | 418/229 |
| 3,769,945 | 11/1973 | Kahre | 418/217 |
| 3,787,153 | 1/1974 | Williams | 418/216 |
| 4,181,480 | 1/1980 | Balsiger | 418/230 |

FOREIGN PATENT DOCUMENTS 3213 of 1891 United Kingdom ..... 418/216

*Primary Examiner*—John J. Vrablik
*Assistant Examiner*—Jane E. Obee
*Attorney, Agent, or Firm*—Robert E. Burns; Emmanuel J. Lobato; Bruce L. Adams

[57] ABSTRACT

A rotary machine which can function as a pump or compressor or a motor, having a stator having a cylindrical working chamber within which is housed a rotor. The rotor is a disk having a major side flat surface and peripheral surfaces in contact with inner surfaces of the housing defining the working chamber. A partition divides the working chamber in two working spaces on a major side of the disk opposite to the flat side thereof. The resliently biased partition makes sliding contact with two symmetrically disposed surfaces of the opposite side. These symmetrical surfaces merge smoothly with an eccentric flat surface and define two symmetrical portions of the disk radially of the eccentric flat surface which have a thickness progressively decreasing axially and in a radial direction away from the eccentric flat surface, i.e., in a direction toward the periphery of the disk. As the disk is rotated, the partition is actuated reciprocably axially of the shaft and maintains a seal between the two chamber working spaces that are continuously varying in volume due to the varying thickness of the disk so that the two chamber working spaces alternatively develop a suction or pressure therein in dependence upon the direction of rotation of the disk. A second embodiment makes use of a rotor constructed as two similar disks that cooperatively reciprocate the partition in two working chambers so that four working spaces are formed and vary in volume.

7 Claims, 10 Drawing Figures

ROTARY MACHINE WITH AN AXIALLY MOVING PARTITION

BACKGROUND OF THE INVENTION

1. Field of the Invention

The present invention relates generally to rotary machines and more particularly, to a construction for use in pumps, compressors and motors with an axially moving partition.

2. Prior Art

Rotary machine constructions are known whose operation or use is as pumps, compressors or motors with a fluid, liquid or gaseous medium.

Rotary machines are known that make use of movable radial partitions between a rotor and a stator. These partitions are installed in radial grooves of the rotor and rotate therewith. Such rotor machines are generally referred to as "vane rotary machines" and possess a high degree of variation of volume of working space filled with the fluid medium as compared to other rotary machines.

In the vane rotary machines, the working space is formed between the internal cylindrical surface of a stator and the rotor surface and varies radially around the rotor. Since there are pressure differentials in the working space, a reliable seal must be effected on the periphery of the partitions to avoid leakage therebetween. However, sealing this type of partition is a very complex problem since the partitions rotate together with the rotor and are influenced by rotor torque. Moreover, their edges interact with the internal cylindrical surface of the stator and with flat end face surfaces of the stator.

If a circumferential seal of the vane partitions is not properly provided, the efficiency of the rotary machine is reduced because of leakage of fluid between the working spaces formed by the vanes thereof. The necessity of providing a proper circumferential seal in the vane rotary machines renders this kind of rotor machine complex in the construction and manufacture thereof.

There is known in the prior art a compressor made as a rotary machine wherein a partition dividing the working space into isolated chambers does not take part in the rotary motion together with the rotor. This machine comprises a cylindrical housing accommodating a shaft arranged along the axis of the housing and having a rotor fixed thereto whose circumferential surfaces are in sliding contact with the internal cylindrical surface of the housing along the entire length. The radially extending surface of the rotor is shaped so that it is in sliding contact with the stationary wall arranged normal to the shaft axis forming together therewith a working space with dimensions variable radially and axially. The space is divided into chambers communicating with inlet and outlet ports and isolated from each other by a partition arranged along the shaft axis and movable in this direction. The partition passes through a radially extending slot in the stationary wall and interacts with a radially extending shaped surface of the rotor. Such an apparatus is described in FRG Pat. No. 2,641,451 patented on March 16, 1978. This known rotary machine is the closest prior art to the rotary machine of the present invention.

SUMMARY OF THE INVENTION

A principal object of the present invention is to provide a rotary machine wherein the rotor and a partition dividing a working space within the housing into isolated chambers are made so as to reduce the possibility of fluid leakage between the isolated working chambers.

Another object is to provide a relatively simple construction of a rotary machine to provide a high efficiency of the machine in terms of its downtime and long-term operation without need of replacing its components.

The rotary machine according to the invention comprises a stator defining a housing having a cylindrical chamber therein. A rotor is mounted rotatively in the chamber and is fixed for rotation on a shaft having one end extending externally of the housing. The rotor is made as a disk. The disk has its peripheral circumferentially disposed surface in sliding contact with the interior cylindrical surfaces of the housing defining the chamber. A major side of the disk has a flat surface effecting a seal with a flat wall surface on a cover of the chamber. An opposite major side of the disk has an eccentric flat surface, which is generally triangular shaped, extending radially inwardly from a peripheral edge of the disk, and as continuation thereof, two symmetrical surfaces extending away from the eccentric flat surface. The two symmetrical surfaces define two portions of the disk on the opposite major side which extend radially and axially away from the eccentric flat surface to the peripheral edge of the disk other than the edge of the periphery of the flat surface. These two symmetrical portions of the disk have a thickness which progressively reduces in a radial and axial direction toward the edge of the periphery of the disk.

A radial partition is mounted by a bushing on the shaft and can move axially of the shaft. The partition divides the chamber disposed relative to the opposite major side of the disk into two separate working spaces. The partition extends through a slot in a flat wall of the housing opposed to the disk symmetrical surfaces and extends into a second chamber of the housing.

The partition is continuously biased into contact with the opposite major side of the disk radially of the eccentric flat surface so that the two symmetrical surfaces function as camming surfaces each through 180° rotation of the disk for reciprocably actuating the partition axially of the shaft as the disk is rotationally driven. The partition functions similarly to a cam follower and maintains a seal between the two working spaces or chamber portions maintaining them continuously isolated from each other.

As the disk is rotated and the partition is axially reciprocably driven, the two working chamber spaces vary in volume both radially and axially. As one of the working chamber working spaces is increasing in volume, the other working space is decreasing in volume.

Two circumferentially displaced ports extend through a flat wall of the housing dividing the housing into the two chambers in which the partition reciprocates. The two parts provide communication into the two working spaces of the chamber. The ports function alternatively as an inlet or an outlet in dependence upon the direction of rotation of the disk. The ports are spaced in a circumferential direction so that they can be closed simultaneously at one point of rotation of the disk, by the eccentric flat surface on the one major side of the disk.

The axially reciprocable partition is resiliently biased by an adjustable spring into contact with the symmetrical surfaces of the disk which are disposed symmetrically on opposite sides of a plane normal to the eccentric flat surface and passing through the axis of rotation of the disk so that the symmetrical surfaces actuate the partition alternately through 180° of rotation of the disk. Provision is made for adjusting the spring compression to compensate for wear of the edge face of the partition in contact with the shaped symmetrical surfaces and contoured complementary with the symmetrical surfaces of the disk for executing the above-described axial movement.

In a second embodiment of the rotary machine according to the invention, the second chamber is made for receiving a second rotary disk constructed similarly to the first-mentioned rotary disk and having its symmetrical surfaces of the portions of the disk reduced in thickness axially disposed opposed to the wall common to the two chambers through which the partition extends. The second disk is disposed on the shaft rotated 180° relative to the position of the first-mentioned disk. The partition wall has an edge face shaped to bear against the second disk symmetrical surface so that the two disks reciprocate the partition axially between them for effectively dividing the second chamber into two other working spaces into which the outlet and an inlet ports communicate so that these other working spaces function in a manner similar to the working spaces of rotor machines with only one rotary disk.

DESCRIPTION OF THE PREFERRED EMBODIMENTS

Figure 1:
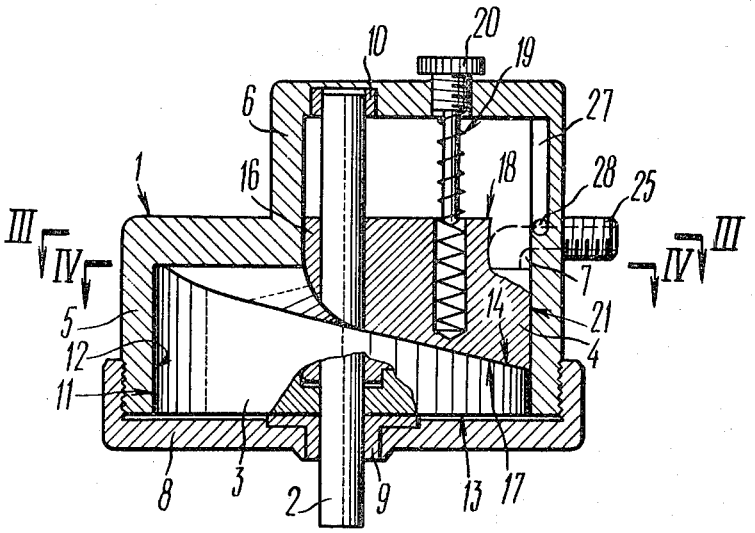
FIG. 1 is a longitudinal cross-section view of a rotary machine according to the invention.

As shown in FIG. 1, the rotary machine comprises a housing 1 on which is mounted a rotary shaft 2 to which is fixed a rotor 3 for rotation therewith and a partition 4 for axial movement relative to the shaft. The housing 1 has a main cylindrical working chamber 5 within which rotates the rotor 3 and a second chamber 6 adjoining the first chamber for receiving the partition 4 as it moves axially of the shaft 2. The two chambers 5, 6 are separated by a common wall 7 which is an integral part of the housing 1. The main or cylindrical working chamber 5 is closed by a cover 8 threaded on the housing as illustrated.

The shaft 2 extends through a journal box 9 of the cover 8 and extends outwardly of the housing and through the wall 7 with an opposite end journaled in journal box 10 secured to a wall of the housing defining the second chamber 6.

Figure 4:
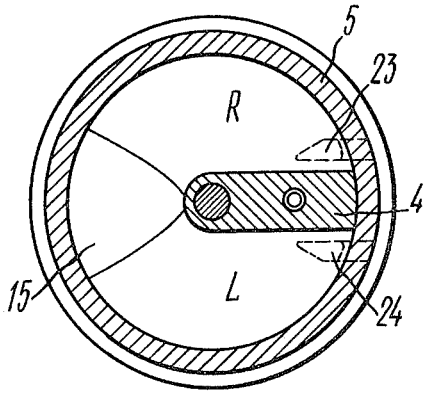
FIG. 4 is a cross-section view taken along cross-section line IV—IV of FIG. 1.

The rotor 3 is a disk having a cylindrical circumferential surface 11 that is in sliding contact with an internal cylindrical surface 12 of the cylindrical working chamber 5 over its entire circumference. The rotor has a major side 13 which is a flat surface opposed to the inside surface of the cover 8 and bearing on the journal box 9. Its opposite major side 14 has an eccentric flat surface 15 opposed to the common wall surface and in contact therewith as shown. The eccentric flat surface is triangular shaped as shown in FIG. 4. The remainder of the major side 14 of the disk 3 comprises two symmetrically disposed surfaces on opposite sides of a plane of symmetry passing through and normal to the flat eccentric surface 15 and passing through the axis of rotation of the disk 3.

Figure 2:
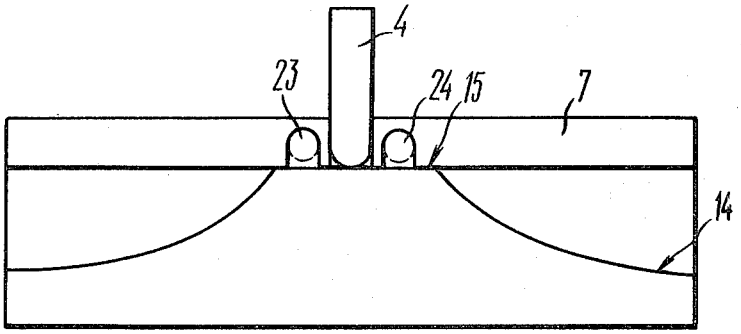
FIG. 2 is a fragmentary schematic developed view of the rotor in FIG. 1 taken at 180° with respect to FIG. 1.
Figure 3:
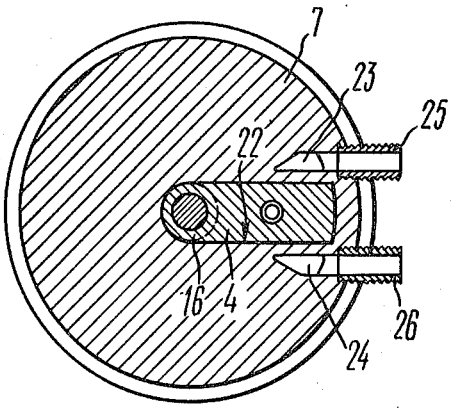
FIG. 3 is a cross-section view taken on cross-section line III—III of FIG. 1.

The symmetrical surfaces merge smoothly with the flat surface 15 and are continuations thereof and extend away from the eccentric flat surface in both opposite directions of rotation axially to the peripheral edge of the disk. The symmetrical surfaces divide the major side 14 of the disk into two symmetrical portions each having a thickness progressively reducing in thickness in both opposite directions of rotation axially toward the edge of the periphery of the disk, as illustrated in FIGS. 1 and 2.

The partition 4 is provided with a bushing 16 mounted on the shaft 2 so that the partition can travel axially on the shaft and the shaft is free to rotate in the bushing.

An end face edge 17 of the partition 4 is shaped complementary to the two symmetrical surfaces to make sealing contact with the surfaces on the major side 14. The opposite edge 18 of the partition is provided with a recess within which is housed a biasing spring 19. The spring is seated against a plug 20 threaded in the wall of the chamber 6 for variably adjusting the compression of the spring 19 and thereby adjusting the biasing force applied by the spring for seating the partition 4 on the major side 14 of the disk for maintaining a seal therebetween. The spring provides compensating adjustment for any wear due to the sliding of the face edge 17 of the partition 4 on the major side 14 surfaces of the disk. An end face edge 21 of the partition 4 is in contact with the internal cylindrical surface 12 of the cylindrical working chamber 5 to effect a seal therebetween.

The wall 7 common to both chambers 5, 6 is provided with a radial slot 22 in which is received the partition 4 for axial movement therein as later explained. The wall 7 is provided with an inlet port 23 and an outlet port 24 providing communication to the cylindrical working chamber 5 through L-shaped passages and communicating with pipe connections 25, 26 connected to a main supply and discharge pipelines, not shown.

The passageways and ports are formed on the common wall 7 and are disposed spaced in a circumferential direction relative to each other so that the passageways can be sealed or closed off simultaneously by the eccentric flat surface 15 during a cycle of rotation of the disk rotor as shown in FIG. 2.

As shown in FIG. 4, the eccentric flat surface describes a limited arc on the periphery of the rotor and converges towards the shaft and the partition 4. The eccentric flat surface 15 and the partition 4 effectively divide the portion of the main chamber relatively to the major side 14 of the disk into two separate and isolated working spaces R and L.

As the rotor rotates, the symmetrical surfaces of the major side 14 function as camming surfaces and the partition 4 functions similarly to a cam follower so that it is actuated reciprocably through one cycle for each rotation of the rotor. As the rotor rotates from the position illustrated in FIG. 1, the partition 4 is actuated or cammed upwardly and downwardly. It can thus be seen that the two working chamber spaces R and L will vary in volume axially in the direction of rotation. When the working chamber portion R is increasing in volume, a suction will be taken through the inlet port 23 through 180° of rotation of the partition 4 and as the eccentric flat surface underlies the ports 23, 24, intake is cut off from the inlet port and as the disk continues to rotate, the eccentric flat surface uncovers the discharge port 24 and the volume of the working chamber L will be at its maximum and then reduce in volume progressively to effect a discharge of fluid through the outlet port 24. This is carried out cyclically with respect to the two working spaces.

It can be readily understood that the above description applies to a rotation of the disk in a counterclockwise direction with respect to the illustration shown in FIG. 4. An opposite direction of rotation or clockwise direction of rotation would cause the port 24 to function as an inlet and the port 23 as an outlet.

The housing is provided with a longitudinal slot 24 communicating with the second chamber 6 in order to prevent effect of any pressure variation on the partition 4 as it is displaced axially. As the partition is displacing axially, pressure varies in the chamber 6 and the effect thereof on the partition is eliminated since the slot 27 communicates through an opening 28 in the housing providing communication the pipe connection 25, the discharge line.

A second embodiment of a rotary machine according to the present invention is illustrated in FIGS. 5–10, inclusive. Therein, reference numerals in the first-described embodiment refer to similar parts. In this second embodiment, the housing has a shaft 2 axially thereof for joint rotation with the rotor made as two disks 3*a*, 3*b* each actuating or camming a partition 4, as later described, and each disposed in a respective working cylindrical chamber 5, 6. A common wall 7 divides the housing into the two working chambers. The shaft extends axially through the two working chambers and is journaled for rotation in journal boxes 9, 10 as shown.

The two disks 3*a*, 3*b* have circumferential peripheral surfaces 11*a*, 11*b* and flat major sides 13*a*, 13*b* opposed to the housing walls as shown. Each has a major side 14*a*, 14*b* opposite to its flat major side that have eccentric flat surfaces 15*c* and substantially flat surfaces 15*d* that merge smoothly with camming ramp surfaces that define symmetrically disposed portions of the corresponding two disks as before described. These symmetrically disposed ramp or camming surfaces are disposed radially of the eccentric flat surfaces 15*c* of the disks and merge smoothly into the substantially flat surfaces 15*d* of the corresponding disks.

Figure 5:
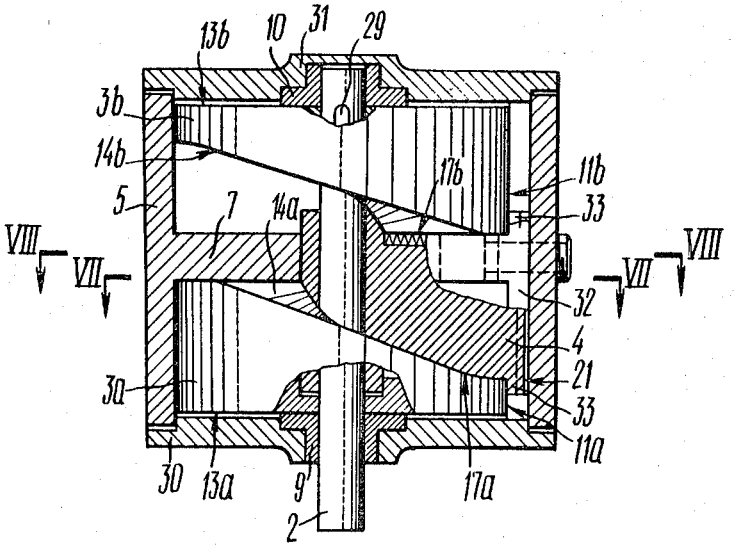
FIG. 5 is a longitudinal cross-sectional view of a second embodiment of a rotary machine according to the invention illustrating the use of two rotors.
Figure 6:
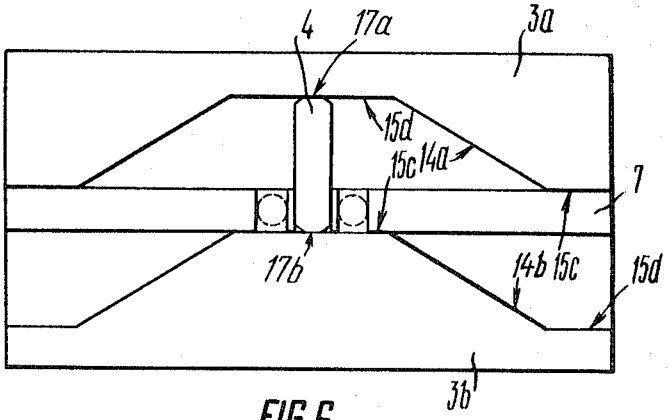
FIG. 6 is a fragmentary schematic developed view of the two rotors in FIG. 5 at 90° to the illustration in FIG. 5.
Figure 7:
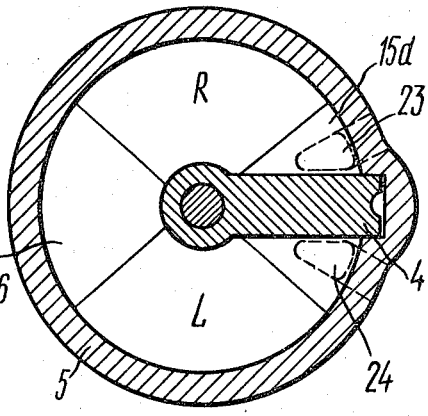
FIG. 7 is a cross-section view taken along section line VII—VII of FIG. 5.

The partition wall 4 in this embodiment has opposite face edges 17*a*, 17*b* that are constructed to slide along the camming or ramp surfaces and are flat to effect a seal with the flat surfaces 15*c*, 15*d* of the disks and have bevelled edges to ride along the ramp surfaces of the sides 14*a*, 14*b* as can be seen in FIG. 6 which is inverted with respect to FIG. 5.

The partition 4 has a projection 21 at the free end thereof. It will be understood that in FIG. 5 the partition 4 is broken away at the free end and that the face edge 17*b* extends along the partition to the free end and terminates at the projection 21, thereof. The upper disk 3*b* is fixed to rotate with the shaft 2 and is disposed rotated 180° relative to the lower disk which is fixed to the shaft for rotation.

The upper disk is free to move axially of the shaft along a keyway 29. It bears on the partition by its weight and maintains close contact between the edge surfaces of the partition 4 and the camming surfaces of the two disks.

As the two disks rotate, the partition 4 is reciprocated along the shaft 2 and the bevelled surfaces of the face edges 17*a*, 17*b* are made so as to ride on the ramp camming surfaces of the disks and maintain an effective seal between the partition and the rotor 3*a*, 3*b*.

The partition thus divides each of the working chambers 5, 6 into two working spaces as before described with respect to the first embodiment. These four working spaces are placed in communication with ports 23, 24 alternately as the working spaces sequentially vary in volume as the disks rotate. The working spaces will function to take a suction at one of the ports and discharge through the other port into the pipe connections 25, 26 as before described in dependence upon the direction of rotation of the disks. In this embodiment, the four working spaces function in sequence.

Figure 8:
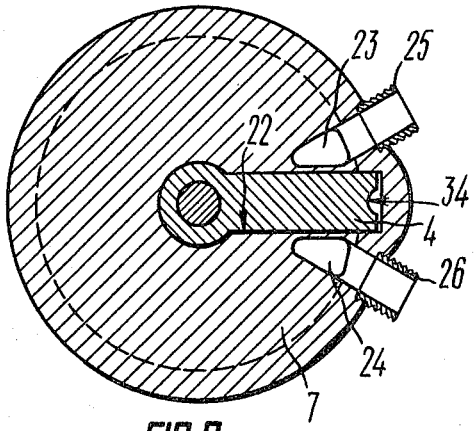
FIG. 8 is a cross-section view taken along section line VIII—VIII of FIG. 5.

The housing has end covers 29, 30 closing the two working chambers and are provided with the journal boxes 9, 10 against which the lower and upper rotors respectively bear. The housing 1 has a longitudinal slot 32 to receive the longitudinal edge 21 of the partition 4. On the side of the longitudinal edge 21, the partition 4 has shoulders 33 that are in sliding contact with the circumferential cylindrical surfaces 11*a*, 11*b* of the disks of the rotor. In order to equalize the fluid pressure acting on the shoulders 33 in the longitudinal slot, a fluted channel 34, FIG. 8, is provided in the edge 21 of the partition 4.

Figure 10:
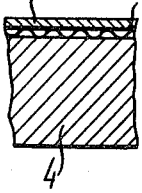
FIG. 10 is a cross-section view taken along section line X—X of FIG. 9.
Figure 9:
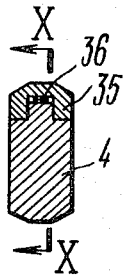
FIG. 9 is a cross-section view of a portion of a partition in FIG. 7.

As shown in FIGS. 9 and 10, the partition 4 has on one of its face edges, 17*a*, a movable tip 35 pressed away from the main body of the partition 4 by a corrugated spring 36. The corrugated spring extends along the full length of the edge face 17*a* of the partition and biases the tip 35, which extends the full length of the spring, into contact with the working surfaces of the upper disk of the rotor. Thus, an effective seal therebetween is maintained.

The rotary machine, according to the second embodiment, functions as a pump or a compressor when the shaft is driven rotationally in a counterclockwise direction the working spaces R progressively increase in volume while the working spaces L progressively decrease. An increase in volume of the working spaces results in the taking of a suction through the inlet port 23. A decrease in volume of the working spaces results in discharge of fluid from therein through the outlet port 24. The rotary machine can thus pump fluids such as liquids and compress gases.

The rotary machines described will also function as motors. Fluid supplied under pressure through the inlet port 23, for example, into a chamber R will cause the rotor to rotate and thereby rotate the shaft 2. At the same time the rotation will effect decrease in volume of a chamber L and fluid therein will be discharged through the outlet port 24.

The rotary machine with the dual disk rotor construction has provision for compensating for wear of the working parts. The end covers 30, 31 can be tightened on the cylindrical housing 1, thus the rotary machines described provide continuous action rotary machines. The variable volume working spaces are developed by use of an axially moving partition forming the working spaces between the rotor and the stator of the machine. This allows for developing high pressures in pumps and compressors. Moreover, the rotary machines, according to the invention, possess the ability to move larger volumes of fluid than in the case of known vane rotary machines.

I claim:

1. A rotary machine construction for use in pumps, compressors and motors, comprising a stator defining a housing having a cylindrical working chamber therein, a rotor rotational in said chamber, a shaft fixed to the rotor and having one end extending externally of the housing, said rotor comprising a disk driven rotationally, said disk having peripheral, circumferentially disposed surfaces in sliding contact with interior surfaces of said housing defining said chamber, the disk having a major side having a flat surface and an opposite major side having an eccentric flat surface extending radially inwardly from a peripheral edge of the disk and having two symmetrical surfaces as continuations of the eccentric flat surface extending away from said eccentric flat surface, the two symmetrical surfaces defining two portions on said opposite major side merging smoothly with the eccentric flat surface and extending progressively axially away from the eccentric flat surface to the edge of the disk at part of the edge of the periphery thereof, said two symmetrical portions thereby having a thickness progressively reducing axially toward said part of the edge of the periphery of the disk, a radial partition mounted for movement axially of said shaft and disposed relative to said opposite major side of the disk dividing the working chamber into two separate chamber working spaces continuously varying in volume as the disk is rotated, means resiliently continuously biasing the partition into contact with said opposite major side of said disk radially of said eccentric flat surface, said two symmetrical surfaces configured for each effectively camming the partition each through 180° and reciprocably actuating the partition as the disk is rotationally driven and the partition functions as a cam follower, and means on said housing defining two circumferentially spaced ports each in communication with a corresponding one of said chamber working space for functioning alternatively as an inlet or outlet in dependence upon the direction of rotation of the disk, said housing having two opposed flat walls defining said chamber, one of said walls having a slot in which said partition reciprocates internally of the housing, said housing defining a second chamber defined by said one flat wall and another flat wall of the housing and disposed axially spaced from said partition, a second disk in said second chamber fixed to said shaft constructed similar to the first-mentioned disk and disposed on said shaft rotated 180° relative to the first-mentioned disk and having symmetrical surfaces of the first-mentioned disk with said one wall therebetween and the disk portions of reducing thickness being rotated 180° relative to each other, said partition being disposed extending through said slot into said chamber to define therein two separate working spaces in conjunction with said symmetrical surfaces of the second disk, said partition having edge face surfaces in sliding contact with corresponding symmetrical surfaces of the individual disks and reciprocably actuated by each disk in a respective corresponding opposite direction of reciprocation as the disks are rotated, and means mounting the second disk for rotation with said shaft and free to move axially on said shaft.

2. A rotary machine construction for use in pumps, compressors and motors according to claim 1, including resilient means resiliently biasing said partition into sliding contact with said opposite major side of said disk to maintain a seal between the two working spaces defined by the partition.

3. A rotary machine construction for use in pumps, compressors and motors according to claim 9, in which said resilient means comprises a spring.

4. A rotary machine construction for use in pumps, compressors and motors according to claim 1, in which said symmetrical surfaces each defines 180° C. of said opposite major side of the disk in conjunction with a part of said eccentric flat surface.

5. A rotary machine construction for use in pumps, compressors and motors, according to claim 4, in which said symmetrical surfaces are disposed symmetrically relative to an axial plane normal to said eccentric flat surface and passing through the axis of rotation of said disk.

6. A rotary machine construction for use in pumps, compressors and motors according to claim 1, including an elongated tip on one of said edge faces of the partition, a spring between the tip and the partition edge face biasing the tip into contact with said second disk symmetrical surfaces.

7. A rotary machine construction for use in pumps, compressors and motors according to claim 6, in which said housing has a slot in which a free end of said partition travels reciprocably.

* * * * *